US008151519B2

(12) United States Patent
Bello et al.

(10) Patent No.: US 8,151,519 B2
(45) Date of Patent: Apr. 10, 2012

(54) POWER SLIDING WINDOW ASSEMBLY WITH CAPS

(75) Inventors: Todd Michael Bello, Canton, MI (US); Jamie Beth Pawloski, Canton, MI (US)

(73) Assignee: Toyota Motor Engineering & Manufacturing North America, Inc., Erlanger, KY (US)

( * ) Notice: Subject to any disclaimer, the term of this patent is extended or adjusted under 35 U.S.C. 154(b) by 398 days.

(21) Appl. No.: 12/425,995

(22) Filed: Apr. 17, 2009

(65) Prior Publication Data

US 2010/0263291 A1 Oct. 21, 2010

(51) Int. Cl.
*E06B 1/00* (2006.01)

(52) U.S. Cl. ..... 49/380; 49/116; 49/118; 49/121; 49/123; 49/360

(58) Field of Classification Search ..... 49/380, 49/13, 116, 118, 121, 123
See application file for complete search history.

(56) References Cited

U.S. PATENT DOCUMENTS 4,995,195 A * 2/1991 Olberding et al. ..... 49/118
5,784,833 A * 7/1998 Sponable et al. ..... 49/360
5,799,444 A * 9/1998 Freimark et al. ..... 49/413
5,822,922 A * 10/1998 Grumm et al. ..... 49/360
6,026,611 A * 2/2000 Ralston et al. ..... 49/123
6,038,819 A 3/2000 Klein
6,119,401 A * 9/2000 Lin et al. ..... 49/361
6,324,788 B1 * 12/2001 Koneval et al. ..... 49/121
6,955,009 B2 * 10/2005 Rasmussen ..... 49/413
7,051,478 B2 5/2006 Bourque et al.
7,073,293 B2 * 7/2006 Galer ..... 49/413
7,155,863 B2 * 1/2007 Daniel et al. ..... 49/413
2003/0188487 A1 * 10/2003 Rasmussen ..... 49/116
2006/0032140 A1 2/2006 Arimoto et al.

* cited by examiner

*Primary Examiner* — Jerry Redman
*Assistant Examiner* — Marcus Menezes
(74) *Attorney, Agent, or Firm* — Gifford, Krass, Sprinkle, Anderson & Citkowski, P.C.

(57) ABSTRACT

A power sliding back window assembly for a motor vehicle is provided. The assembly can include a window casing with a first window pane and a second window pane fixedly attached thereto. Also included can be a generally U-shaped guide rail that has a first end and an oppositely disposed second end. A third window pane having a portion or edge fixedly attached to a glass carrier can also be included. A first cap can be attached to and located at least partially within the first end of the generally U-shaped guide rail and a second cap can be attached to and located at least partially within the second end of the generally U-shaped guide rail.

7 Claims, 5 Drawing Sheets

POWER SLIDING WINDOW ASSEMBLY WITH CAPS

FIELD OF THE INVENTION

The present invention is related to a power sliding window and in particular to a power sliding window assembly that has an cap.

BACKGROUND OF THE INVENTION

The rear window of a pickup truck can be made such that at least part of the window will slide back and forth. In so doing, an individual in the cab of the truck can have access to the bed of the truck and/or allow air to enter the cab by opening the back window. In some instances, the rear window can be powered such that at least part of the back window slides back and forth through the use of an electrical and/or mechanical device. In such instances, a sliding window pane will typically slide at least partially within a window guide rail that is at least partially encased within a window casing. In addition, the window casing can be made by injection molding of a polymer resin.

Heretofore back window assemblies have used caps at the ends of the window guide rail. The caps can prevent the window casing material from flowing into the guide rail during injection molding of the casing and before the casing material has cured into a solid structure. However, such caps have previously not provided simple and direct access from a window pane sliding system to the sliding window pane. As such, a power sliding window assembly that has an improved cap would be desirable.

SUMMARY OF THE INVENTION

A power sliding window assembly for a motor vehicle is provided. The assembly can include a window casing with a first window pane and a second window pane fixedly attached thereto. The second window pane can be spaced apart from the first window pane. Also included can be a generally U-shaped guide rail that has a first end and an oppositely disposed second end. The generally U-shaped guide rail may or may not be at least partially encased within the window casing adjacent to the first window pane and the second window pane.

A third window pane having a portion or edge fixedly attached to a glass carrier can also be included. The glass carrier can have a first end and an oppositely disposed second end, the glass carrier located at least partially within and slidably engaged with the generally U-shaped guide rail. A first cap can be attached to and located at least partially within the first end of the generally U-shaped guide rail and a second cap can be attached to and located at least partially within the second end of the generally U-shaped guide rail. In some instances, the first cap and the second cap are rigidly attached to the U-shaped guide rail by being at least partially encased within the window casing.

The first cap and the second cap each have a body with a top surface, a bottom surface, an inner end surface and an oppositely disposed outer end surface. The end surfaces extend between the top surface and the bottom surface and a cable slot can be included that extends from the outer end surface to the inner end surface. The cable slot extends in a downwardly direction from the top surface into the body of the cap and has a lower surface that is located a predetermined distance from the top surface. A counter-bore can also be present, the counter-bore extending from the outer end surface into the body towards the inner end surface. The counter-bore can have a cable housing abutment surface located a predetermined distance from the outer end surface and be coaxial with the lower surface of the cable slot.

A window pane sliding system can be included with a first cable housing having a first cable extending therethrough and a second cable housing having a second cable extending therethrough. The first cable can pass through the cable slot and at least part of the first cable housing can be located within the counter-bore of the first cap. Likewise, the second cable can pass through the cable slot and at least part of the second cable housing can be located within the counter-bore of the second cap. In addition, the first cable can be attached to the first end of the glass carrier and the second cable can be attached to the second end of the glass carrier. In this manner, the window pane sliding system can be operable to slide the third window pane between a closed position and an open position by alternately pulling on the first cable and the second cable. In addition, with the first and second caps having the cable slot extending in a downwardly direction from the top surface, the cables can be installed and attached to the glass carrier after the end caps have been attached to the generally U-shaped guide rail.

The first cap and the second cap can each have an abutment flange that extends in a generally outward direction from the body, the abutment flange of the first cap being in contact with the first end of the generally U-shaped guide rail and the abutment flange of the second cap being in contact with the second end of the generally U-shaped guide rail. The first cap can have a guide rail support tab that is spaced apart from the body and extends from the abutment flange in a direction towards the second cap. Likewise, the second cap can have a guide rail support tab that is spaced apart from the body and extends from the abutment flange towards the first cap. In addition, at least part of the first end of the generally U-shaped guide rail can be located between the body and the guide rail support tab of the first cap and at least part of the second end of the generally U-shaped guide rail can be located between the body and the guide rail support tab of the second cap.

The bodies of the first cap and the second cap can each have an inner portion that is located between the abutment flange and the inner end. The inner portion can have a width at the inner end that is less than a width at the abutment flange. This change in width can afford for an angled body that aids in the installation of the caps within the generally U-shaped guide rail during fabrication of the assembly. In some instances, a cushion can be included and be attached to the inner end of the first cap and/or the second cap. In addition, the cushion can be a crown-shaped cushion that may or may not have a stick-resistant textured surface that reduces adhesion between the crown-shaped cushion and an end of the glass carrier when the glass carrier is initially in contact with the cap and later moved away from the cap.

DETAILED DESCRIPTION OF THE INVENTION

Figure 1:
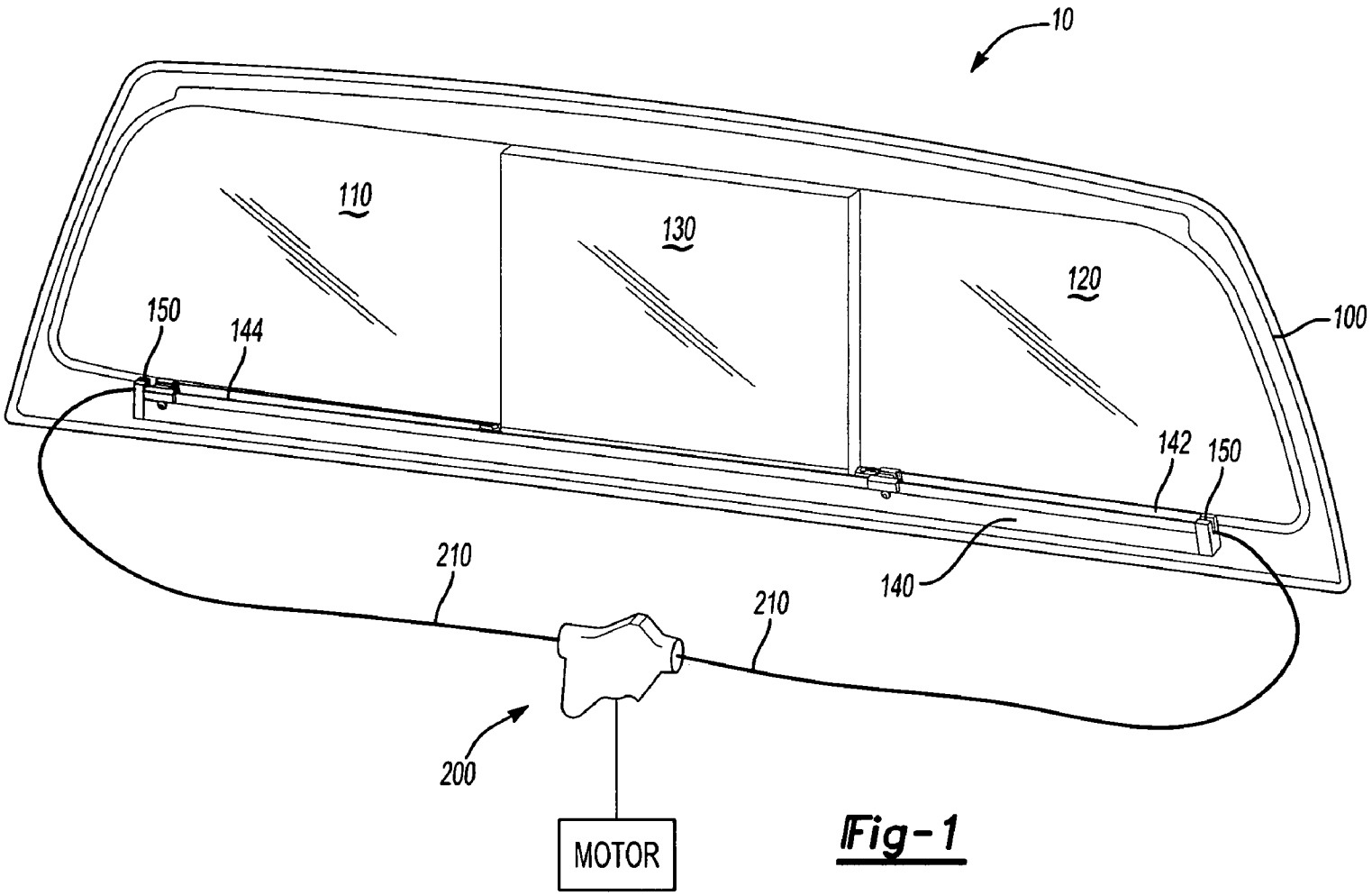
FIG. 1 is a perspective view of a power sliding window assembly according to an embodiment of the present invention.

The present invention discloses a power sliding window assembly. In some instances, the power sliding window assembly can be a rear window assembly for a pickup truck and the like. As such, the invention has utility as a component for a motor vehicle.

The power sliding window assembly can include a first window pane and a second window pane fixedly attached to a window casing. The second window pane can be spaced apart from the first window pane, thereby affording an opening between the two window panes. A third window pane can be provided and be operable to slide back and forth between a closed position where the opening between the first window pane and the second window pane is blocked by the third window pane and an open position where the opening is not blocked.

A generally U-shaped guide rail having a first end and an oppositely disposed second end can be at least partially encased within the window casing, however, this is not required. In addition, the third window pane can have a portion or edge that is fixedly attached to a glass carrier, the glass carrier located at least partially within and slidably engaged with the generally U-shaped guide rail. In this manner, the third window pane can slide back and forth with respect to the generally U-shaped guide rail and thus the first and second window panes.

A first cap can be rigidly attached to and located at least partially within the first end of the generally U-shaped guide rail and a second cap can be rigidly attached and located at least partially within the second end of the generally U-shaped guide rail. The first cap and the second cap, also known as an end cap or end caps, can each have a body with a top surface, a bottom surface and an inner end surface oppositely disposed from an outer end surface. The two end surfaces can extend between the top surface and the bottom surface.

Each of the caps can also have a cable slot that extends in a downwardly direction from the top surface into the body between the outer end surface and the inner end surface. The cable slot can have a lower surface that is located a predetermined distance from the top surface. A counter-bore that extends from the outer end surface into the body in a direction towards the inner end surface can also be included, the counter-bore having a cable housing abutment surface that is located a predetermined distance from the outer end surface. In addition, the counter-bore can be coaxial with the lower surface of the cable slot.

The third window pane can be attached to a window pane sliding system that has a first cable housing with a first cable extending therethrough and a second cable housing with a second cable extending therethrough. The first cable can pass through the cable slot of the first cap and at least part of the first cable housing can be located within the counter-bore thereof. Likewise, the second cable can pass through the cable slot of the second cap and at least part of the second cable housing located within the counter-bore thereof. The first cable can be attached to a first end of the glass carrier and the second cable can be attached to a second end of the glass carrier. In addition, with the cable slots extending downwardly from the top surface, the first cable and the second cable can be installed and attached to the glass carrier after the end caps have been attached to the generally U-shaped guide rail. Stated differently, heretofore caps have required that cables from a window pane sliding system pass through the cap before a ferule is attached to the end of the cable and the cable is attached to the glass carrier. However, the inventive caps disclosed herein allow for subsequent installation of the cables after the caps have been installed and allows the cable(s) to be serviceable after installation without disassembly thereof. The first cap and the second cap can further prevent the flow of window casing material into the generally U-shaped guide rail during molding of the window casing.

The first cap and the second cap can be fixedly attached to the generally U-shaped guide rail by being at least partially encased within the window casing, however this is not required. In addition, the caps can each have an abutment flange that extends in a generally outward direction from the body, the abutment flange of the first cap being in contact with the first end of the generally U-shaped guide rail and the abutment flange of the second cap being in contact with the second end of the generally U-shaped guide rail. As such, the abutment flange affords for desirable placement of the caps partially within the generally U-shaped guide rail.

The first cap can have a guide rail support tab that is spaced apart from the body and extends from the abutment flange towards the second cap. Likewise, the second cap can also have a guide rail support tab spaced apart from the body of the second cap and extends from the abutment flange towards the first cap. At least part of the first end of the generally U-shaped guide rail can be located between the body and the guide rail support tab of the first cap and at least part of the second end of the generally U-shaped guide rail can be located between the body and the guide rail support tab of the second cap. In this manner, the caps can provide structural support to the generally U-shaped guide rail.

In some instances, the caps can include a cushion that is attached to and extends from the inner end. The cushion can be a crown-shaped cushion that may or may not have a stick-resistant textured surface that reduces adhesion between the crown-shaped cushion and one of the ends of the glass carrier.

Turning now to FIG. 1, a power sliding window assembly is shown generally at reference numeral 10. The assembly 10 can have a window casing 100, a first window pane 110, a second window pane 120 and a sliding third window pane 130. Also included can be a generally U-shaped guide rail 140 that has a first end 142 and an oppositely disposed second end 144. In some instances, the assembly 10 can be a back window assembly that has a power sliding window device 200 with at least one cable assembly 210.

Figure 2:
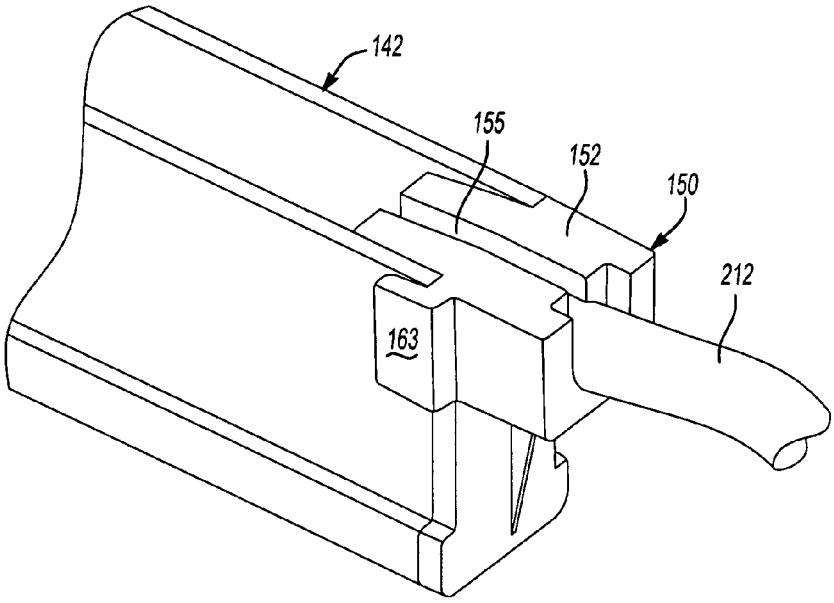
FIG. 2 is a perspective view of a generally U-shaped guide rail with an cap located at least partially therewithin.

FIG. 2 illustrates the first end 142 of the generally U-shaped guide rail 140 before it has been at least partially encased within the back window casing 100. Also shown is an cap 150 with a cable housing 212 extending at least partially therein.

Figure 3:
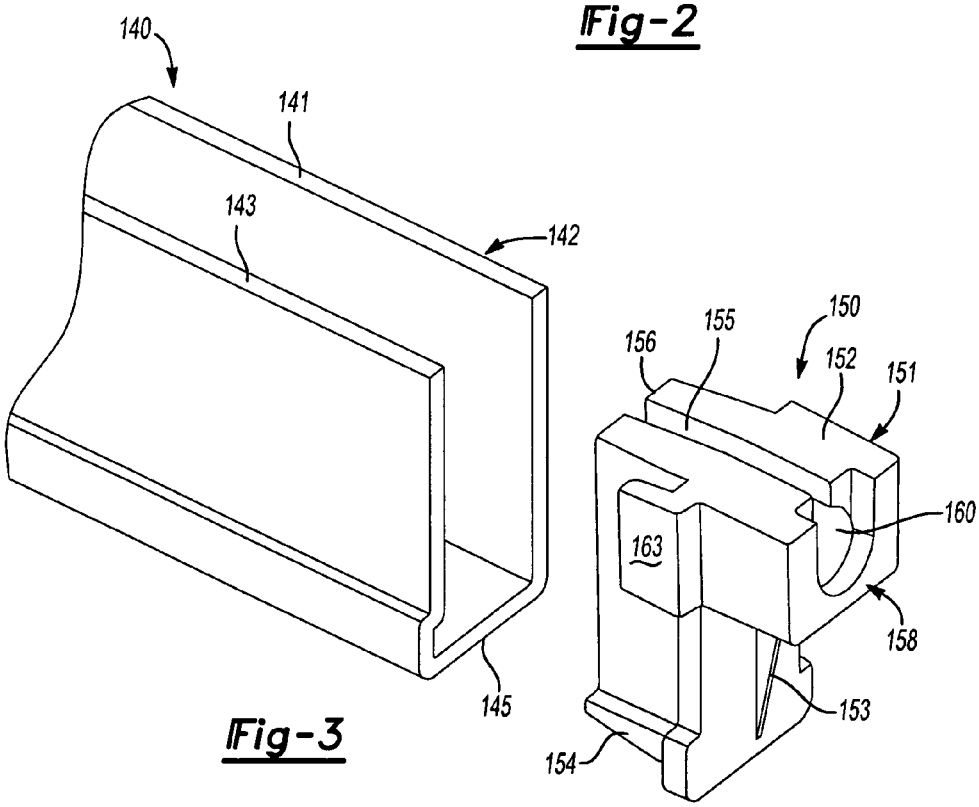
FIG. 3 is an exploded view of the generally U-shaped guide rail and cap shown in FIG. 2.

Turning now to FIG. 3, an exploded view of the first end 142 of the generally U-shaped guide rail 140 and the cap 150 is shown. The generally U-shaped guide rail 140 can have a first wall 141, a second wall 143 and a bottom wall 145 extending between the first wall 141 and the second wall 143. It is appreciated from FIG. 3 that the first end 142 has an end surface (not numbered). In this manner, a generally U-shaped structure is provided. The cap 150 can have a body 151 with a top surface 152 and a bottom surface 154. An inner end surface 156 and an oppositely disposed outer end surface 158 can extend between the top surface 152 and the bottom surface 154. In some instances, the outer end surface 158 can provide a step surface with a reinforcement rib 153 as shown in the figure. The cap 150 can also have a cable slot 155 that extends between the inner end surface 156 and the outer end surface 158 in a downwardly direction from the top surface 152.

Figure 4:
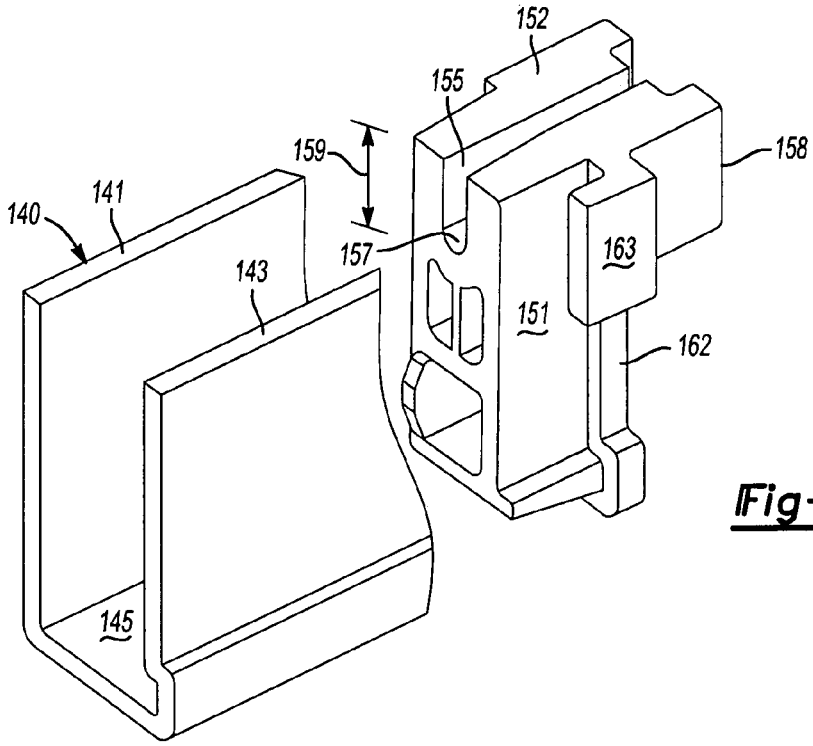
FIG. 4 is an end view of an inner end surface for the cap shown in FIG. 3.
Figure 5:
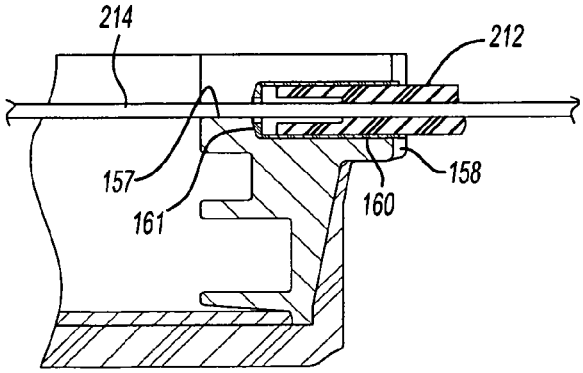
FIG. 5 is a side cross-sectional view of the generally U-shaped channel and cap shown in FIG. 2 with the addition of a resin encapsulation and a cable.

Turning now to FIG. 4, the cable slot 155 can have a bottom surface 157 that is located at a predetermined distance 159 from the top surface 152. In addition, a counter-bore 160 can extend from the outer end surface 158 into the body of the cap 150 with a cable housing abutment surface 161 located a predetermined distance from the outer end surface 158. As shown in FIG. 5, the counter-bore 160 can be coaxial with the lower surface 157 of the cable slot 155.

In some instances, the cap 150 can have an abutment flange 162 that extends in an outwardly direction from the body 151 of the cap. The abutment flange 162 can be in contact with the end surface of the first end 142 of the generally U-shaped guide rail 140. In addition, a second cap can be attached to the second end 144 of the generally U-shaped guide rail 140 and also have an abutment flange that is be in contact with an end surface of the second end 144.

A guide rail support tab 163 can also be included, the guide rail support tab 163 extending from the abutment flange 162 in a direction towards inner end surface 156. In addition, the guide rail support tab 163 can be spaced apart from the body 151 of the cap 150 such that the first wall 141 and/or the second wall 143 of the generally U-shaped guide rail 140 can fit between the body of the cap 150 and the guide rail support tab 163 as illustrated in FIG. 2.

Figure 6:
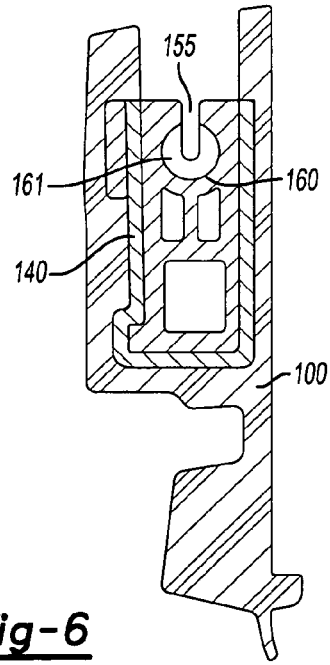
FIG. 6 is an end cross-sectional view of the generally U-shaped guide rail and cap shown in FIG. 2 with the addition of a resin encapsulation.

Referring to FIG. 6, the cable housing 212 can be located at least partially within the counter-bore 160 and may be in contact with the cable housing abutment surface 161. In this manner, the cable housing 212 can be held at a fixed location. In addition, the cable 214 can pass through the slot 155 and the cap 150 can be at least partially enclosed or encased within the back window casing 100, however, this is not required.

Figure 7:
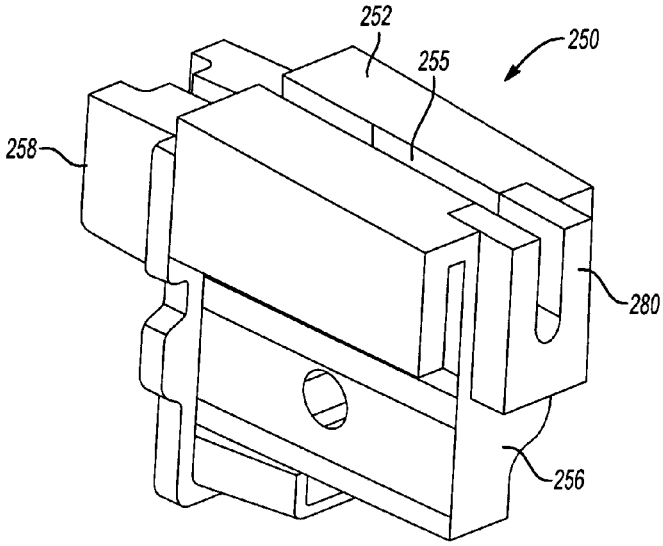
FIG. 7 is a perspective view of an cap having a cushion.
Figure 8:
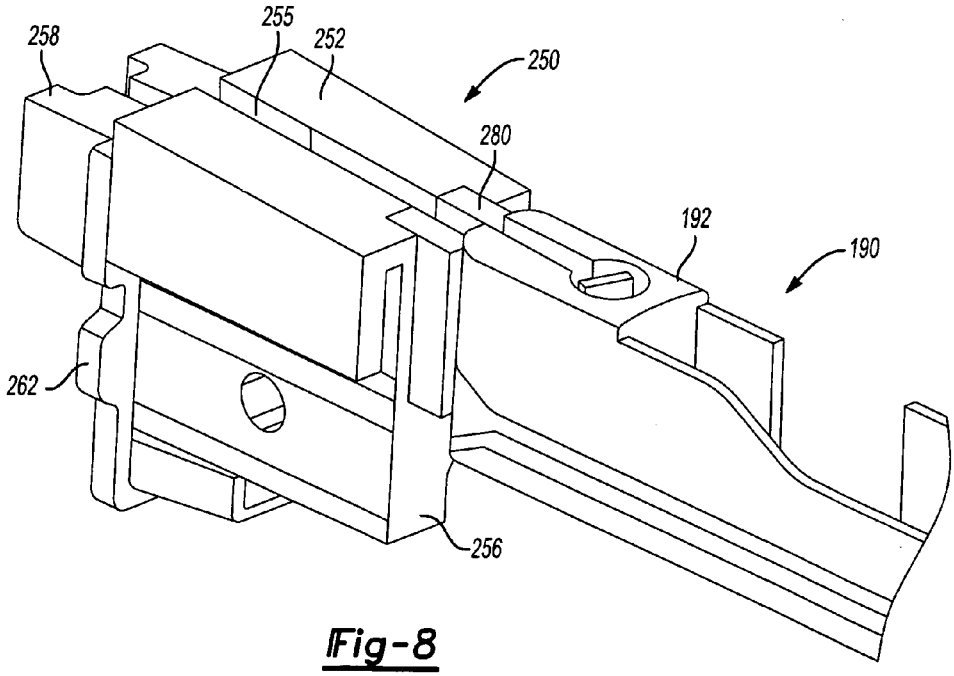
FIG. 8 is a perspective view of the cap shown in FIG. 7 in contact with a glass carrier.

Turning now to FIGS. 7 and 8, a different embodiment of the cap 150 is shown at reference numeral 250 where like features as shown in FIGS. 1-6 are identified by reference numerals being greater by 100 than the reference numerals in the previous figures. The cap 250 may or may not have a cushion 280 extending from and being attached to an inner end surface 256 of the cap 250. The cushion 280 can come in contact with an end 192 of a glass carrier 190 that is fixedly attached to the third window pane 130. In this manner, contact between the third window pane 130 or the glass carrier 190 and the cap 250 can be dampened by the cushion 280.

Figure 9:
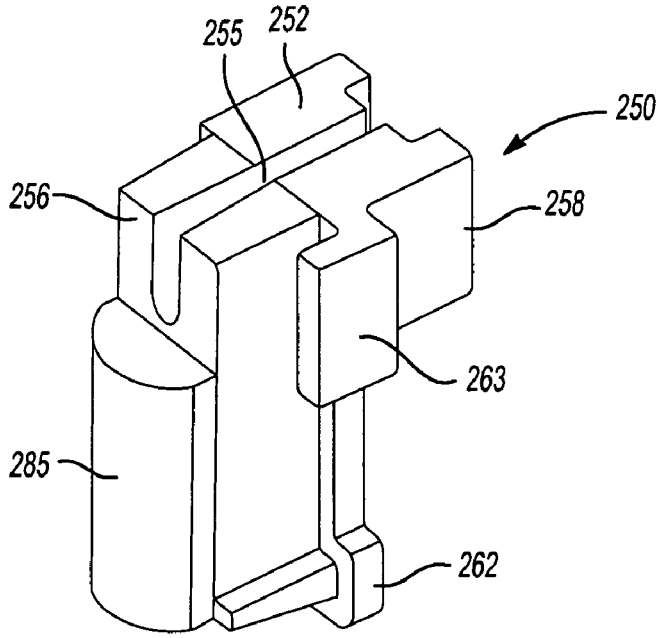
FIG. 9 is a perspective view of an cap having a crown-shaped cushion.
Figure 10:
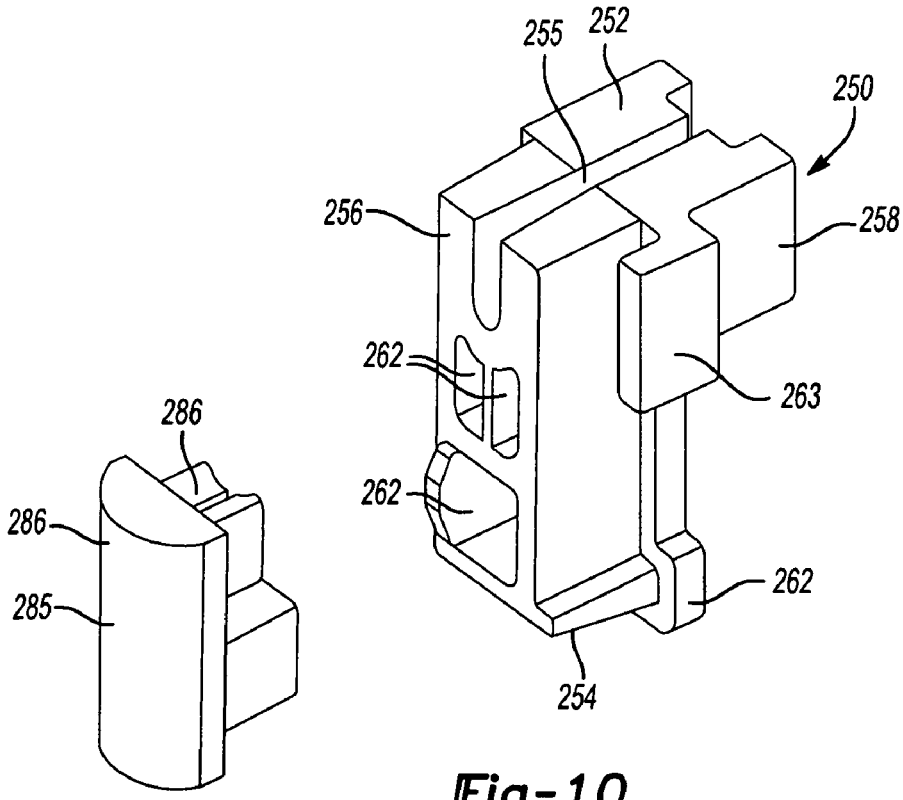
FIG. 10 is an exploded perspective view of the cap and crown-shaped cushion shown in FIG. 9.

FIGS. 9 and 10 illustrate the cushion 280 in the form of a crown-shaped cushion 285. The crown-shaped cushion 285 can have one or more mechanical interlocking tabs 286 that interlock with the cap 250 using apertures 262. In this manner, the position and location of the cushion 285 can be maintained during continued operation of the power sliding window assembly 10. In addition, the crown-shaped cushion 285 can have a textured surface, for example and for illustrative purposes only, a stick-resistant textured surface 286 that can reduce adhesion between the cap 250 and the end 192 of the glass carrier 190 when the glass carrier is initially in contact with the cap and then is later moved away therefrom.

It is appreciated that the various components of the power sliding back window assembly can be made from any material known to those skilled in the art. For example and for illustrative purposes only, the window panes can naturally be made from glass while the back window casing can be made from a polymer material such as polyvinyl chloride resin. In addition, the caps can be made from a polymer material such as glass-filled nylon while the cushions can be made from an elastomer, for example a polyether based thermoplastic polyurethane. The stick-resistant surface of the crown-shaped cushion can be made using any type of surface texturing process known to those skilled in the art that provides an adhesion reducing surface. In some instances, the textured surface on the cushion is provided by a tool surface being etched with a textured surface and the tool textured surface being in contact with the surface of the cushion when it is formed. For example, the surface of a molding cavity in which the cushion is formed can be etched with a textured surface, a general mirror image of the molding cavity surface being produced on the cushion surface when it is produced.

As such, the foregoing drawings, discussion and description are illustrative of specific embodiments of the present invention, but they are not meant to be limitations upon the practice thereof. Numerous modifications and variations of the invention will be readily apparent to those of skill in the art in view of the teaching presented herein. It is the following claims, including all equivalents, which define the scope of the invention.

We claim:

1. A power sliding window assembly for a motor vehicle, said assembly comprising:

a generally U-shaped guide rail having an end with a distal end surface;

a slidable window pane located at least partially within and slidably engaged with said generally U-shaped guide rail;

a cap having a body with a top surface and being rigidly attached to and located at least partially within said end of said generally U-shaped guide rail;

said cap having a cable slot extending downwardly from said top surface, said cap also having an abutment flange extending in a generally outward direction from said body and in contact with said end surface of said generally U-shaped guide rail;

a window pane sliding system having a cable extending through said cable slot and attached to said slidable window pane;

whereby said window pane sliding system is operable to move said slidable window pane by pulling on said cable, and said cap with said cable slot extending downwardly from said top surface operable to allow assembly of said cable through said cable slot and attachment to said slidable window pane after said cap has been rigidly attached to said generally U-shaped guide rail, wherein said cap has a guide rail support tab spaced apart from said body and in contact with the distal end surface, said guide rail support tab extending from said abutment flange towards an inner end surface of said cap located within said generally U-shaped guide rail.

2. The assembly of claim 1, further including a window casing, said cap at least partially enclosed within said window casing.

3. The assembly of claim 2, wherein said generally U-shaped guide rail is at least partially encased within said window casing.

4. The assembly of claim 2, wherein said cap is a first cap and a second cap, said first and second caps at least partially encased within said window casing.

5. The assembly of claim 1, wherein at least part of said end surface of said generally U-shaped guide rail is located between said body and said guide rail support tab of said cap.

6. The assembly of claim 1, wherein said cap has a counter-bore and a cable housing abutment surface.

7. The assembly of claim 6, wherein said cable has a housing, said housing located at least partially within said counter-bore and in contact with said cable housing abutment surface.

* * * * *